US005513540A

United States Patent [19]

Giometti

[11] Patent Number: 5,513,540

[45] Date of Patent: May 7, 1996

[54] ENGINE STARTER GEARING HAVING IMPROVED GREASE RETENTION

[75] Inventor: Paul F. Giometti, Horseheads, N.Y.

[73] Assignee: Purolator Products N.A., Inc., Tulsa, Okla.

[21] Appl. No.: 284,373

[22] Filed: Aug. 2, 1994

[51] Int. Cl.[6] ..... F02N 15/06

[52] U.S. Cl. ..... 74/7 A; 74/6

[58] Field of Search ..... 74/6, 7 A

[56] References Cited

U.S. PATENT DOCUMENTS

| | | | |
|---|---|---|---|
| 4,366,385 | 12/1982 | Williams | 290/38 R |
| 4,395,923 | 8/1983 | Giometti | 74/7 R |
| 4,425,812 | 1/1984 | Williams | 74/6 |
| 4,524,629 | 6/1985 | Digby | 74/7 R |
| 4,611,499 | 9/1986 | Giometti | 74/6 |
| 4,627,299 | 12/1986 | Mortensen, Sr. | 74/7 A |
| 4,712,435 | 12/1987 | Losey et al. | 74/6 |
| 4,715,239 | 12/1987 | Giometti | 74/6 |
| 4,744,258 | 5/1988 | Vilino | 74/7 R |
| 4,768,392 | 9/1988 | Giometti | 74/6 |
| 4,777,836 | 10/1988 | Giometti | 74/6 |
| 4,843,897 | 7/1989 | Tallis, Jr. | 74/6 |
| 4,912,991 | 4/1990 | Giometti | 74/6 |
| 5,050,441 | 9/1991 | Giometti | 74/7 C |
| 5,237,882 | 8/1993 | Giometti | 74/7 A |

*Primary Examiner*—Allan D. Herrmann
*Attorney, Agent, or Firm*—Joseph V. Tassone

[57] ABSTRACT

An engine starter gearing for starting an engine having a starter gear includes a power shaft and a housing affixed on the power shaft. The housing retains an axially displaceable driven clutch member. An internal groove is provided within an open end of the housing. The driven clutch member has an enlarged external diameter portion that fits within the housing. The driven clutch member is held in position by a compressed spring retained within the housing. An installation groove is formed in the driven clutch member spaced away from the enlarged diameter portion. A lock ring is positioned within the housing by first inserting it in the installation groove. The driven clutch member is axially depressed inwardly within the housing, compressing the spring until the locking ring snaps in position in the housing internal groove. The locking ring has an internal diameter that closely fits the external diameter of the driven clutch member forming a grease seal so that as the driven clutch member is axially displaced relative to the housing during starting operations, the escape of grease from the housing is reduced.

3 Claims, 2 Drawing Sheets

ENGINE STARTER GEARING HAVING IMPROVED GREASE RETENTION

CROSS-REFERENCE TO RELATED APPLICATIONS

This application is not related to any pending patent applications.

CROSS-REFERENCE TO MICROFICHE APPENDIX

This application is not related to any microfiche appendix.

BACKGROUND OF THE INVENTION

This invention relates to engine starter gearing of the positive shift type, including a dentil clutch to provide driving and overrunning features and including a provision for effecting the automatic separation of the clutch teeth after the engine becomes self-running. Particularly, the invention relates to engine starter gearing having grease therein with improved means of retention of the grease during starting operations.

DESCRIPTION OF THE PRIOR ART

For background information relating to the general subject matter of this invention, reference may be had to the following United States Patents:

| U.S. Pat. No. | Title |
|---|---|
| 4366385 | ENGINE STARTER DRIVE |
| 4395923 | ENGINE STARTER GEARING |
| 4425812 | ENGINE STARTER DRIVE DEVICE |
| 4524629 | COMPACT ENGINE STARTER DRIVE |
| 4611499 | ENGINE STARTER GEARING |
| 4627299 | ENGINE STARTER GEARING |
| 4712435 | ENGINE STARTER GEARING |
| 4715239 | ENGINE STARTER GEARING |
| 4744258 | NON-INDEXING ENGINE STARTER GEARING |
| 4768392 | ENGINE STARTER DEVICE |
| 4777836 | ENGINE STARTER GEARING |
| 4843897 | ENGINE STARTER GEARING |
| 4912991 | THRUST RING FOR A STARTER CLUTCH |
| 5050441 | ENGINE STARTER GEARING |
| 5237882 | ENGINE STARTER GEARING WITH LAMINATED CUSHION WASHERS |

U.S. Pat. No. 5,050,441 is representative of the prior art. This patent discloses a centrifugal disengageable engine starter gear of the positive shift type that has a clutch to provide for driving and indexing the starter gear. The engine starter gearing has a pinion gear that is shifted on a power shaft to engage a starter gear. A compression spring within a housing on the power shaft permits a limited amount of movement of the pinion gear with respect to the housing during starting operations. The pinion gear is retained in position in the housing by means of a lock ring. Previously employed methods of installing the lock ring provide a circumferential groove in the pinion gear below the lock ring so that close contact is not provided between the interior of the lock ring and pinion gear. The lack of close contact allows the possibility of the loss of grease during shifting operations. An objective of the present invention is to provide an improved engine starter gearing with improved means of mounting the lock ring so that close contact is thereafter retained between the interior circumferential surface of the lock ring and the pinion gear to reduce the possibility of the loss of grease during shifting operations.

BRIEF SUMMARY OF THE INVENTION

The engine starter gearing of this invention includes a power shaft having an axis of rotation. A sleeve is received on the power shaft. The sleeve can slide on the shaft but rotates with it. The sleeve has external helical splines on its exterior surface. A pinion gear is slidable journalled for axial movement on the sleeve. The pinion gear and sleeve are structured for movement of the pinion gear into and out of engagement with an engine starting gear.

A driving clutch member is slidably mounted on the sleeve, the driving clutch member having internal helical splines that engage the external helical splines formed on the sleeve. A driven clutch member is integral with the pinion gear and is disposed adjacent to the driving clutch member. The driven clutch member has an inner end spaced from the pinion gear. The driven clutch member also has an integral increased diameter portion adjacent to the inner end and an external installation groove spaced from the increased diameter portion. The housing has an internal circumferential groove adjacent to the open end.

Complementary mutually engageable inclined teeth are provided for transmitting torque between the driving clutch and the driven clutch members.

The housing has an open end and is slidably supported on the sleeve and spatially encompasses the driving clutch member and a portion of the driven clutch member. A spring is disposed within the housing for biasing the driving clutch member towards the driven clutch member and towards the complementary mutually engageable inclined teeth to force them into engagement.

An expandable locking ring is received in the housing internal circumferential groove for abutment against the driven clutch member increased diameter portion to thereby retain the driven clutch member within the housing. The diameter of the driven clutch member adjacent the increased diameter portion is dimensioned to closely fit the locking ring.

In the existing design of engine starter gearings, as represented by the previously issued United States patents mentioned heretofore, as particularly represented by U.S. Pat. No. 5,050,441, grease is lost from the indexing engine starter gearing through an area between the pinion or driven clutch member and the pinion lock ring. When the drive is greased greater than the specified amount, the grease instead of air is forced to escape from behind the clutch and pinion during indexing through the space between the pinion and pinion lock ring. When the pinion returns to the rest position, the grease is forced out of the drive and is left on the outside and air is drawn into the drive to replace the grease. An objective of the present invention is to eliminate or at least substantially decrease the rate of grease loss from the indexing action of an engine starter gearing.

This objective is realized by a seal design that reduces the space between the pinion and pinion lock ring to cause restriction against the outward flow of grease. By slowing the grease loss, the life of the engine starter gearing can be increased. To achieve this result, an installation groove is formed in the pinion gear rearward cylindrical portion that is spaced forwardly of the increased external diameter integral portion. This permits the locking ring to be assembled into its final position in the groove formed in the housing by first inserting the locking ring into the installation groove in the pinion gear cylindrical portion followed by inwardly depressing the pinion gear relative to the housing until the locking ring is aligned with the housing internal groove. The locking ring self expands into the housing internal groove. When inward force on the pinion gear is relieved, the pinion gear is urged forwardly by spring action so that the increased diameter portion engages the locking ring to retain the pinion gear secured. The surface of the pinion gear below the locking ring is in close proximity thereto significantly reducing area in which grease loss can occur.

A better understanding of the invention will be obtained from the following description and claims, taken in conjunction with the attached drawings.

DESCRIPTION OF THE PREFERRED EMBODIMENTS

Figure 1:
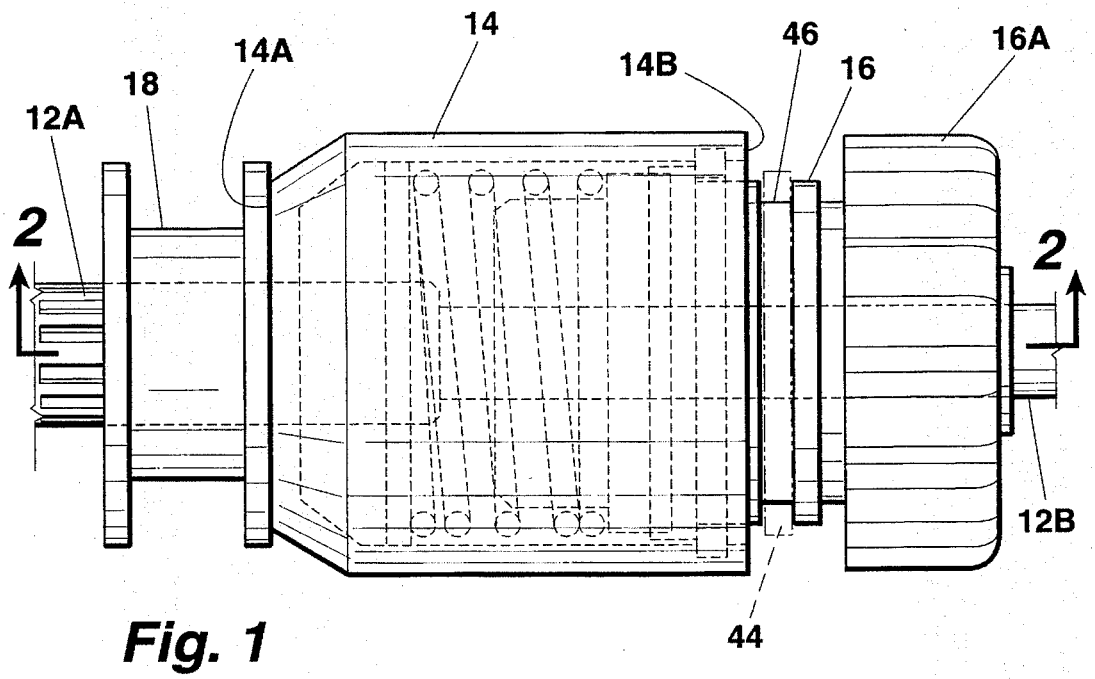
FIG. 1 is an external view of an engine starter gearing in which the present invention is employed.

Referring to FIG. 1, the external appearance of an engine starter gearing is illustrated. The engine starter gearing is mounted on a power shaft, portions 12A and 12B of which are seen in FIG. 1. The power shaft 12A, 12B extends from a starter motor, not shown. A splined portion 12A of the power shaft and a reduced diameter portion 12B are shown. Mounted on the power shaft is housing 14 having a closed end 14A and an open end 14B. Extending from the housing open end 14B is a driven clutch member 16 having, at its outer end, an integrally formed pinion gear 16A.

Adjacent to housing closed end 14A is a yoke member 18.

Figure 3:
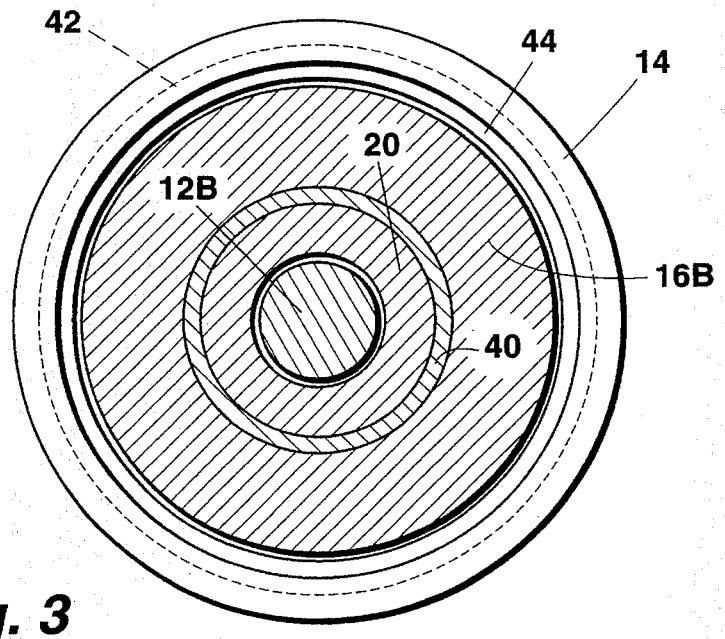
FIG. 3 is a cross-sectional view of the engine starter gearing as taken along the line 3—3 of FIG. 2.
Figure 2:
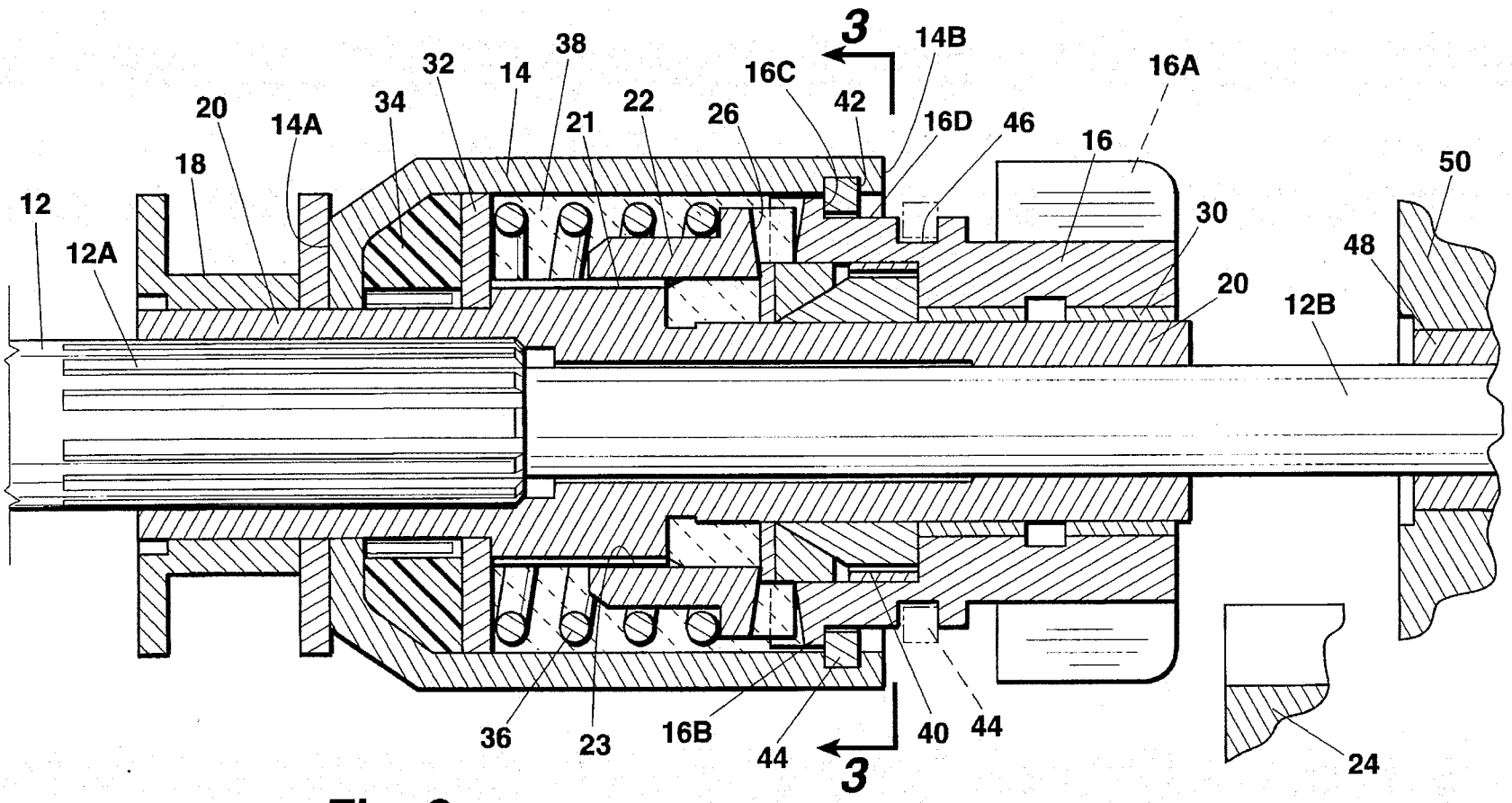
FIG. 2 is an elevational enlarged cross-sectional view of the starter gearing taken along the line 2—2 of FIG. 1. Bearing support for the power shaft outer end and engine starter gearing are shown in FIG. 2 that do not appear in FIG. 1.

Turning now to FIGS. 2 and 3, the internal components making up the engine starter gearing is illustrated. An axially extending sleeve 20 is connected to the power shaft splined portion 12A by internal splines so that sleeve 20 is axially moveable but rotatably fixed to power shaft 12A, 12B. A portion of the external surface of sleeve 20 has external helical splines 21 formed thereon. A driving clutch member 22 has internal helical splines 23 threaded into the external helical splines 21 of the axially extending sleeve 20. Driving clutch member 22 is therefore adapted for movement of pinion gear 16A towards and away from a starting gear 24 of the engine to be started. That is, driving clutch 22 moves toward and away from driven clutch 16B. The driving clutch member 22 is illustrated in its engaged position in the drawing in which it projects past the right end of the axially extending sleeve 20.

The forwardly extending, reduced diameter portion of sleeve 20 is slidably supported on the reduced diameter portion 12B of power shaft 12. A driven clutch member 16 is journalled on bearing 30 which is press fitted into driven clutch member 16. Bearing 30 is mounted on sleeve 20 thereby permitting drive clutch member 16 and its integral pinion gear 16A to be axially and rotatably moveable relative to power shaft 12. Pinion gear 16A is structured for movement into and out of engagement with starting gear 24 of the engine to be started.

Adjacent faces of driving clutch member 22 and driven clutch member 16 are each provided with dentil teeth (not seen) which provide complementary mutually engageably inclined torque transmitting surfaces. The dentil teeth are of sawtooth variety to provide a one-way, overrunning clutch connection. For details as to this feature of the engine starter gearing, reference may be had to United States Patent 5,050,441 that is incorporated herein by reference.

As previously stated, housing 14 has an open end 14B and a closed end 14A and is slidably supported at its closed end on an external surface of axially extending sleeve 20. Housing 14 is barrel-shaped and fitted over the driving clutch member 22 and partially over the driven clutch member 16.

Axially extending sleeve 20 is provided with a radial shoulder in an intermediate location to provide an abutment for a washer 32. A resilient yieldable annular member 34, preferably formed of an elasticly deformable material, such as rubber, is compressibly confined between washer 32 and the closed end 14A of housing 14. A coil spring 36 is compressibly confined within a cavity 38 within housing 14 between washer 32 and the driving clutch member 22 to provide a biasing force urging the driving clutch member 22 in engagement with the driven clutch member 16.

An advancement apparatus, not illustrated in the drawings but well known in the art, is provided for moving the starter drive towards and away from starting gear 24 of the engine by means of engaging yoke 18.

The starter drive is provided with a centrifugal clutch separator assembly, generally indicated by the numeral 40, to effect disengagement of the driving clutch member 22 from the driven clutch member 16 when the engine to which the starter is connected is running above a predetermined speed. Clutch separator assembly 40 serves to avoid excessive wear of the mutually engageable dentil clutch teeth previously mentioned. For a detailed description of a centrifugal clutch separator assembly 40, reference may be had to U.S. Pat. No. 5,050,441.

Driven clutch member 16 has an increased diameter radially extending portion 16B providing a circumferential radial surface 16C.

Formed on the circumferential internal cylindrical surface of housing 14, adjacent open end 14B, is an internal circumferential groove 42. Positioned within groove 42 is a lock ring 44. The function of lock ring 44 is to retain driven clutch member 16 in position with and respect to housing 14 and to thereby retain the other internal components within the housing in their secured positions.

As previously stated, a problem with the previously known engine starter gearing, as exemplified in U.S. Pat. No. 5,050,441, is that during starting action, when the driven clutch member 16 is displaced rearwardly with respect to housing 14, that is, in the direction towards housing closed end 14A, the possibility of leakage of grease from the housing internal cavity 38 occurs. To alleviate this problem, the engine starter gearing as disclosed in FIGS. 1, 2, and 3 includes, in the driven clutch member 16, a remotely positioned installation groove 46. Installation groove 46 is spaced from driven clutch member radial surface 16C in the direction towards pinion gear 16A. By this arrangement, an uninterrupted external cylindrical surface 16D is provided on driven clutch member 16 adjacent radial surface 16C. Locking ring 44 is dimensioned so that in its secured position as shown in solid outline in FIG. 2, its internal diameter closely approaches the external diameter of driven clutch member external surface 16D. This permits the driven clutch member to be axially displaceable relative to locking ring 44 but provides minimal space between locking ring 44 and driven clutch member 16 for the escape of grease.

Installation groove 46 is spaced at a sufficient distance away from driven clutch member radial extending portion 16B so that it is not aligned beneath locking ring 44 during normal operation of the engine starter gearing. Installation of lock ring 44 is achieved as follows: lock ring 44 is placed within installation groove 46, the lock ring being shown in dotted outline as it is held in a collapsed condition. The driven clutch member 16 is then axially displaced relative to housing 14 in the direction towards housing closed end 14A, compressing spring 36. Driven clutch member 16 displaces inwardly until locking ring 44 positioned within installation groove 46 aligns with groove 42 in housing 14. When in such alignment, the locking ring snaps into position within groove 42 after which axially inward force on driven clutch member 16 may be released causing spring 36 to return it to the location indicated in FIG. 2 wherein radial surface 16C engages the locking ring to retain driven clutch member 16 in position. Thus, installation groove 46 is employed only during the installation of locking ring 44 and thereafter has no other function.

As previously indicated, since the locking ring internal circumferential surface closely fits driven clutch member external cylindrical surface 16D during most normal operations of the engine starter gearing, the possibility of escape grease is substantially reduced, thereby helping to ensure a longer useful life for the engine starter gearing.

FIG. 2 shows the reduced diameter portion 12B of power shaft 12 supported at its outer end within bearing 48 as seen in FIG. 1, the bearing being positioned within support 50. Support 50 is typically an integral part of a starter motor, the other portions of the starter motor not being shown.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An engine starter gearing for starting an engine having a starting gear, comprising:

a power shaft having an axis of rotation;

a sleeve is slidably positioned on and rotatably secured to said power shaft, said sleeve having external helical splines formed on one portion of the exterior surface thereof;

a pinion gear slidably journalled on said sleeve for axial movement relative thereto, said pinion gear structured for movement into and out of engagement with said starting gear of said engine;

a driving clutch member slidably mounted on said sleeve, said driving clutch member having an internal helical spline engaging said external helical splines formed on said sleeve;

a driven clutch member integral with said pinion gear and being disposed adjacent to said driving clutch member, the driven clutch member having an inner end spaced from said pinion gear, the driven clutch member having an integral increased diameter portion adjacent said inner end and an external installation groove spaced remotely from said increased diameter portion, providing an uninterrupted cylindrical surface;

means for transmitting torque in one direction of rotation between said driving clutch member and said driven clutch member;

a housing having an open end, said housing being slidably supported on said sleeve and spatially encompassing said driving clutch member and a portion of said driven clutch member, and having an internal circumferential groove adjacent said open end, the housing having grease therein;

resilient means disposed within said housing for biasing said driving clutch member towards said driven clutch member; and an expandable locking ring received in said housing internal circumferential groove for abutment against said driven clutch member increased diameter portion to thereby retain said driven clutch member within said housing, the locking ring having an internal diameter, the diameter of said driven clutch member uninterrupted cylindrical surface adjacent said increased diameter portion and said locking ring internal diameter being dimensioned to closely fit so as to reduce the escape of grease from said housing.

2. An engine starter gearing according to claim 1 wherein said locking ring is installable in said housing circumferential groove by positioning said locking ring in said installation groove and inwardly displacing said driven clutch relative to said housing while maintaining said ring in a compressed condition until said ring is aligned with said housing internal groove.

3. An engine starter gearing according to claim 1 including means retained within said housing of providing separation of said driving clutch member and said driven clutch member when said engine starts to rotate said pinion gear and driven clutch member faster than said driving clutch member is rotated.

* * * * *